United States Patent [19]

Berthel et al.

[11] 4,260,973

[45] Apr. 7, 1981

[54] PLUG-IN ELECTROMAGNETIC RELAY

[75] Inventors: Karl Berthel, Roth; Olaf Schmid, Schwabach; Berthold Walter, Oberasbach; Ludwig Spechner, Nuremberg; Theodor Sturm, Sachsen; Hans-Peter Degel, Ansbach, all of Fed. Rep. of Germany

[73] Assignee: Robert Bosch GmbH, Stuttgart, Fed. Rep. of Germany

[21] Appl. No.: 90,045

[22] Filed: Oct. 31, 1979

[51] Int. Cl.[3] ..... H01H 63/02

[52] U.S. Cl. ..... 335/133; 335/196

[58] Field of Search ..... 335/128, 129, 133, 196, 335/202, 203

[56] References Cited

U.S. PATENT DOCUMENTS

| | | | |
|---|---|---|---|
| 2,892,053 | 6/1959 | Lambert et al. | 335/128 |
| 3,156,797 | 11/1964 | Smith | 335/133 X |
| 3,997,859 | 12/1976 | Miller | 335/128 |

FOREIGN PATENT DOCUMENTS

| | | | |
|---|---|---|---|
| 998627 | 7/1965 | United Kingdom | 335/133 |

*Primary Examiner*—George Harris

*Attorney, Agent, or Firm*—Frishauf, Holtz, Goodman & Woodward

[57] ABSTRACT

A relay capable of being assembled by machine and electrically connected by dip-soldering operations to metallic strips having prongs passing through an insulating base plate to provide plug-in connections, has metallic leads, lugs and strips preshaped so that when they are mounted in the base plate or the winding spool, as the case may be, pairs of them will interfit at locations where they are then soldered by dip soldering.

9 Claims, 4 Drawing Figures

PLUG-IN ELECTROMAGNETIC RELAY

This invention concerns an electromagnetic relay of the kind in which the electrical connections are brought to the base plate in the form of flat metal plug-in tongues. In such relays it is necessary to provide electrical contact between the various elements mounted on the base plate and the contact tongues passing through the base plate.

In a known type of relay, for example the kind shown in German Utility Model No. 72 35 698, the connections for the relay winding are first soldered to loose plug-in tongues which in a later work operation in the assembly of the relay are set into the base plate. This has the disadvantage that the parts of the relay must be soldered by hand and to a great extent assembled by hand, which is inconvenient as well as time and cost consuming.

SUMMARY OF THE INVENTION

It is an object of the invention to constitute the metal parts of the relay that are to be connected electrically in such a way that they can be mechanically set into the base plate and, so far as necessary, connected to each other electrically by dip-soldering.

Briefly, certain of these metallic parts are formed with shaping in the neighborhood of where they are connected, such that when the parts are inserted into the base plate, they bear against each other or interfit to form at least one connection zone.

The relay according to the invention has the advantage that by the inserting of the different relay parts into the base plate, soldering zones for a mechanical dip-soldering operation are produced, so that the relay can be largely produced on automatic machinery. Furthermore, by the same basic constitution of the relay different variations of the relay can be made without change of the assembly-line. Welded connections can be provided for in a similar manner. In that case, for provision of a welding zone, regions of the parts to be connected are so shaped that they lie against each other when assembled. They can then be electrically welded with automatic welding equipment.

It is particularly useful to constitute the base plate with a cavity into which an electrical component to be connected in parallel with a relay winding selectively can be so inserted that the connection leads form soldering zones with corresponding cut-outs of connecting parts of the relay. By such provisions, a separation of the individual soldering locations can be obtained without additional expense and a high quality of soldering and effective inspection of the soldering locations can be assured.

The invention is further described by way of illustrative example with reference to the accompanying drawings, in which.

Figure 1:
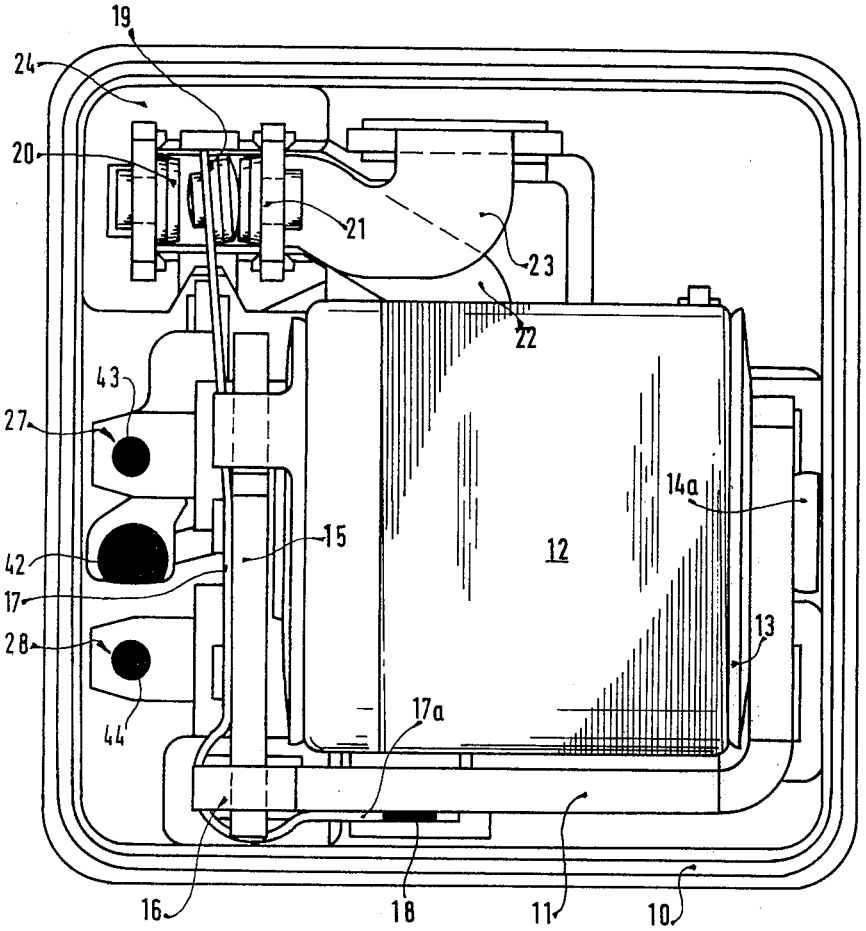
FIG. 1 is a top view of a relay according to the invention with the insulating cover removed.
Figure 2:
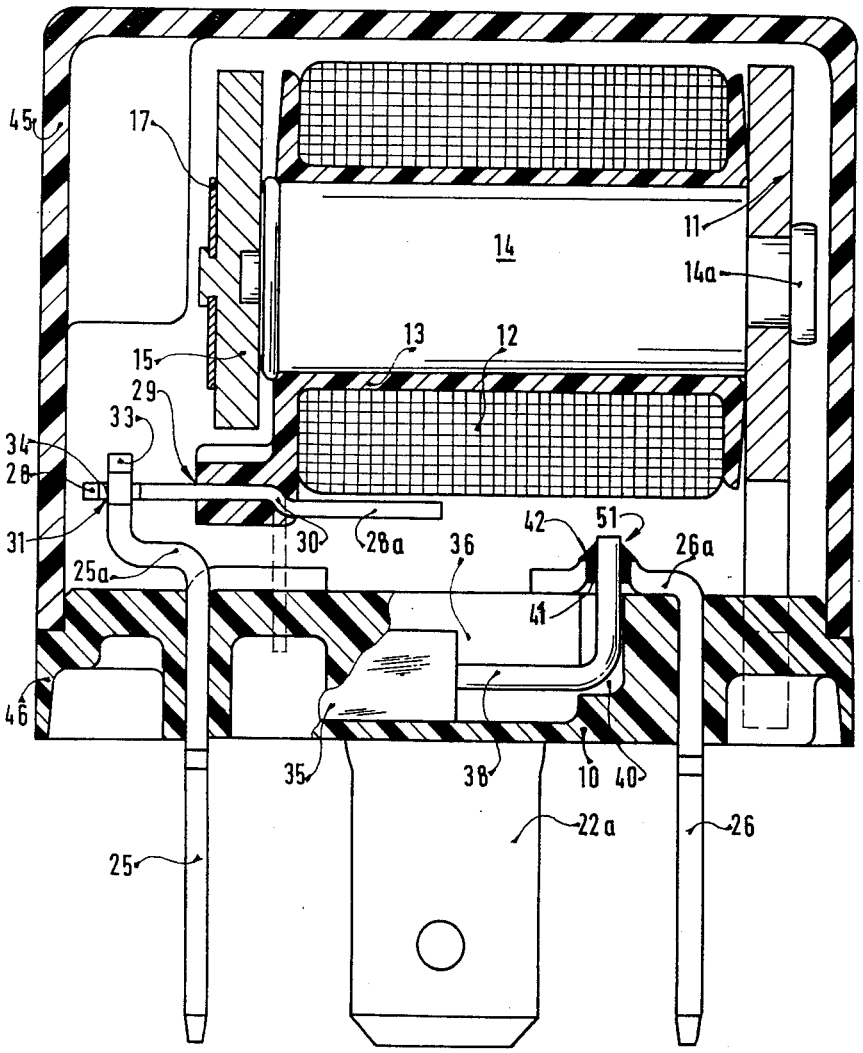
FIG. 2 is the same relay in a side view, in section.

FIGS. 1 to 4 show a small relay of the kind usable in a motor vehicle. It has a base plate 10 injection molded of insulating material upon which an L-shaped magnet yoke 11 is fastened. A relay winding 12 with its spool frame 13 is mounted by being pushed into place on an iron core 14, the back end 14*a* of which is riveted to the short leg of the L-shaped magnet yoke 11. A hinged flat armature 15 is mounted so as to swing in a cutout 16 at the end of the long leg of the magnet yoke 11. As FIGS. 1 and 2 show, when the relay winding is energized, it lies against the end face of the iron core 14. The armature 15 carries a contact spring 17 the bent-over rear end 17*a* of which is fastened by a spot weld 18 to the magnet yoke 11 and the front end of which carries a switching contact 19. The contact 19 is disposed between counter-contacts 20 and 21 that are welded into metal strips 22 and 23. In order to put the counter-contacts 20 and 21 in their prescribed positions, the metal strips 22 and 23 are taken up in a guideway in a raised portion 24 of the base plate 10 that permits no play for the metal strips and holds both sides, running perpendicular to the base plate 10. The counter-contact 20 serves as the quiescent state contact, sometimes referred to as the back contact or normal contact, against which the transfer contact 19 lies when the relay winding is not energized. The counter-contact 21 forms the working or operating contact, sometimes known as the front contact, against which the transfer contact 19 lies when the relay winding 12 is energized. The metal strips 22 and 23 for the respective counter contacts 20 and 21 are constituted at their outer ends as flat prong tongues of a plug-in contact structure extending through the base plate. In FIG. 2, only the front flat prong tongue 22*a* can be seen. The connections for the relay winding 12 are provided by two additional flat prong tongues 25 and 26 set in the base plate 10.

The relay winding 12 has its wire ends soldered to solder lugs 27 and 28 that are pushed into slots 29 of the spool frame 13, one of these being visible in FIG. 2. The section 28*a* of the solder lug 28 that is soldered to an end of the relay winding wire has a place of bending 30 at which this section 28*a*, before soldering of the relay winding 12, as shown in dashed lines in FIG. 2, is bent away and, after soldering, is bent back towards the relay winding 12 in order to relieve the wire end of tension. The other end of the relay winding is connected in the same way with the solder lug 27.

For electrical connection of the relay winding 12 with the flat prong tongues 25 and 26, stamped or bent-out parts are provided on the regions 25*a* and 26*a* of the tongues 25 and 26 lying above the base plate 10 in such a way that when these tongues are set in the base plate 10, these deformations engage with those of the lugs 27 and 28 to form the solder zones 31. The regions 25*a* and 26*a* of the flat prong tongues 25 and 26 lying above the base plate 10 have for this purpose in each case a vertically bent-up point 32,33 that projects into a corresponding stamped-out hole 34 of the soldered lug 27 or 28 as the case may be, to form the solder zone 31.

Figure 3:
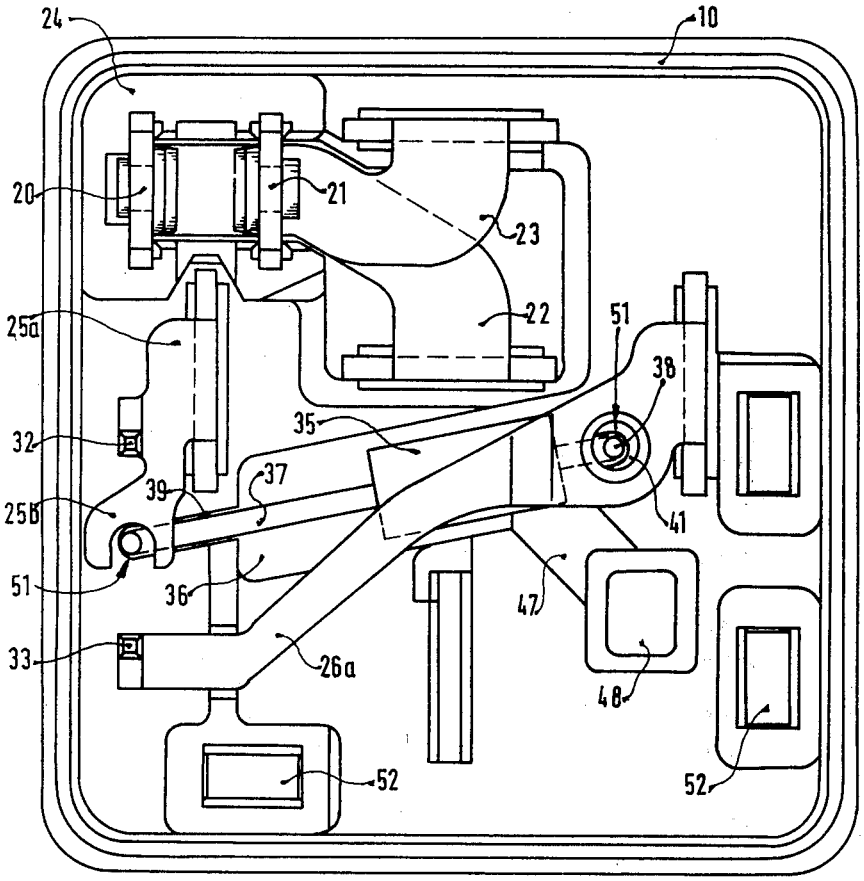
FIG. 3 is a plan view of the base plate of the relay with the connection pieces and a diode.

A diode 35 is connected in its normally blocking sense in parallel with the relay winding 12 to prevent the occurrence of high induction voltages upon switching off of the winding. This diode 35 lies in a cavity 36 of the base plate 10. It has pre-bent connection leads 37 and 38 that are positioned in corresponding slots 39 and 40 of the base plate 10 in such a way that their ends stick out perpendicularly from the base plate as shown in FIG. 3 and project into corresponding cutouts in the regions 25*a* and 26*a* of the flat prong tongues 25 and 26 for the formation of solder zones 51. In the region 25*a* of the flat prong tongue 25, the cutout is provided by a jawshaped stamped end section 25*b* in which the end of the connection lead 27 of the diode 35 projects. In the region 26*a* of the flat prong tongue 26, on the other hand, the cutout is a stamped-out hole 41 forming a passage through which the end of the connection lead 38 of the diode passes. The cavity 36 is so disposed that by inserting in the base plate somewhat differently shaped metal parts instead of the parts 25*a* and 26*a*, an electrical component could also be inserted in series with the relay winding 12.

For assembly of the relay by machine, the diode 35 is first placed in the cavity 36 of the base plate 10 and then the flat prong tongues 25 and 26, as well as the metal tongued strips 22 and 23 carrying the counter-contacts 20 and 21, are inserted in the base plate 10. In this condition, which is represented in FIG. 3, the ends of the connection leads 37 and 38 of the diode 35 are now soldered to the regions 25*a* and 26*a* of the flat prong tongues 25 and 26 at the solder locations 51 by a dip-soldering operation. The soldering location 42 thus formed is visible in FIG. 1. In a further operation, the magnet yoke 11 with its pre-mounted relay winding 12 and the flat-type armature 15 is inserted by tongues into corresponding sockets 52 of the base plate 10, at which time the points 32 and 33 of the flat prong tongues 25 and 26, as shown in FIG. 2, project into the holes 34 of the solder lugs 27 and 28 to form further solder zones 31. With a second dip-soldering operation, the solder locations 43 and 44 visible in FIG. 1 are now formed at these solder zones 31.

Figure 4:
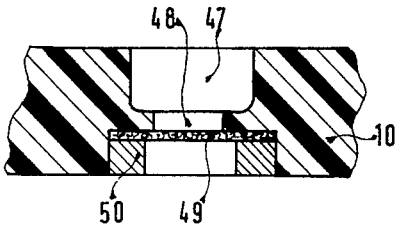
FIG. 4 is a section of a portion of the base plate, on larger scale, showing a cavity in the base plate illustrated in FIG. 3 with a filter installed therein.

In order to protect the relay parts mounted on the base plate 10 against moisture, these parts are surrounded by a cap of insulating material 45 that is sealed in water-tight fashion around the edge of the base plate 10. Besides, the base plate has a drip edge 46 running around its underside. In order that moisture, that for example collects in the interior of the insulating cap 45 when there are strong fluctuations of temperature, should be able to be drained, the cavity 36 of the base plate 10 is connected by a channel 47 with an opening 48 lying at the deepest part of the base plate 10. As FIG. 4 shows, the opening 48 can also, if desired, be closed off by a filter 49 that is impermeable to water but is capable of "breathing", which for example may be a PTFE foil, available under the trademark TEFLON, provided with a clamping ring 50.

Although the invention has been described with reference to a particular illustrative embodiment, it will be evident that modifications and variations are possible within the inventive concept.

We claim:

1. An electromagnetic relay of plug-in construction comprising:

a base plate (10) constituted of electric-insulation material;

a magnetic yoke (11) affixed to said base plate;

a magnetic core (14) mounted on said yoke;

a relay winding (12) wound on a spool (13), said spool being mounted on said core and said winding having wire ends electrically connected to metallic solder lugs (27,28) held in said spool;

an armature movably mounted on said yoke and provided with a movable relay contact (19);

a plurality of metallic strips having flat-prong tongues (22,23,25,26) held in said base plate (10) and extending therethrough for plug-in connections for said relay;

at least one counter-contact (20,21) mounted on one of said metallic strips (22,23) individual to it; and at least one additional electrical component (35) set on or in said base plate (10) and having metallic leads extending therefrom;

a plurality of said metallic parts, denominated as lugs strips and leads, having formed portions shaped for interfitting with another of said metallic parts so as to provide a plurality of connection zones (31,51), disposed suitably for dip-soldered connections.

2. An electromagnetic relay as defined in claim 1 in which at least one of said metallic strips has in its portion that lies on the opposite side of said base plate (10) from the connection tongue of the strip an upwardly bent point (32,33) directed perpendicularly away from said base plate (10) which projects into a cut-out (34) of another of said metal parts (27,28) for providing one of said connection zones (31).

3. An electromagnetic relay as defined in claim 2 in which said cut-out (34) in said metallic part (27,28) part is in a hole (34) in each of said solder lugs (27,28).

4. An electromagnetic relay as defined in claim 3 in which each of said solder lugs (27,28) is bent in its mid-portion (30), whereby in manufacture bending away from said winding prior to soldering and bending back after soldering for release of connection tension are facilitated.

5. An electromagnetic relay as defined in claim 2 in which at least one of said metallic strips has, in the region thereof located on the other side of said base plate (10) from the connection tongue of said strip, a cut-out into which the end of one of said connection leads (37,38) of said component (35) projects.

6. An electromagnetic relay as defined in claim 5, in which said component (35) lies in a cavity (36) of said base plate (10) and the connection leads (37,38) of said component are positioned by slots (39,40) of said base plate (10) so that said ends of said leads stand upperpendicularly from said base plate and project into cut-outs (25*b*, 41) respectively of two of said metallic strips and are soldered thereto.

7. An electromagnetic relay as defined in claim 5 or 6, in which said cut-out of at least one of said strips (25) is an open indentation (25*b*) in an end of said strip.

8. An electromagnetic relay as defined in claim 5 or 6, in which said cut-out of a strip (26) is an aperture (41) stamped out of the strip.

9. An electromagnetic relay as defined in claim 6, in which said cavity (36) in said base plate (10) is provided with drain channel (47) connecting said cavity through an opening (48) through said base plate (10) at the deepest place of the side of base plate on which said magnet yoke is mounted.

* * * * *